US010614817B2

(12) United States Patent
Wang et al.

(10) Patent No.: US 10,614,817 B2
(45) Date of Patent: *Apr. 7, 2020

(54) RECOVERING HIGH FREQUENCY BAND SIGNAL OF A LOST FRAME IN MEDIA BITSTREAM ACCORDING TO GAIN GRADIENT

(71) Applicant: Huawei Technologies Co., Ltd., Shenzhen (CN)

(72) Inventors: Bin Wang, Beijing (CN); Lei Miao, Beijing (CN); Zexin Liu, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/043,880

(22) Filed: Jul. 24, 2018

(65) Prior Publication Data

US 2018/0330738 A1 Nov. 15, 2018

Related U.S. Application Data

(63) Continuation of application No. 14/981,956, filed on Dec. 29, 2015, now Pat. No. 10,068,578, which is a (Continued)

(30) Foreign Application Priority Data

Jul. 16, 2013 (CN) ..... 2013 1 0297740

(51) Int. Cl.
*G10L 19/00* (2013.01)
*G10L 19/005* (2013.01)
(Continued)

(52) U.S. Cl.
CPC ..... *G10L 19/005* (2013.01); *G10L 19/0208* (2013.01); *G10L 21/0232* (2013.01); *G10L 25/93* (2013.01); *G10L 2025/937* (2013.01)

(58) Field of Classification Search
CPC ..... G10L 19/005
(Continued)

(56) References Cited

U.S. PATENT DOCUMENTS 5,450,449 A 9/1995 Kroon
5,699,485 A 12/1997 Shoham
(Continued)

FOREIGN PATENT DOCUMENTS

AU 2009267433 A1 1/2010
CA 2865533 A1 9/2013
(Continued)

OTHER PUBLICATIONS

Machine Translation and Abstract of Chinese Publication No. CN1012915737, Feb. 6, 2013, 27 pages.
(Continued)

*Primary Examiner* — Shaun Roberts
(74) *Attorney, Agent, or Firm* — Conley Rose, P.C.

(57) ABSTRACT

A method for recovering lost frame in a media bitstream, where when a frame loss event occurs, a decoder obtains a synthesized high frequency band signal of a current lost frame, and recovery information related to the current lost frame, determines a global gain gradient of the current lost frame, and determines a global gain of the current lost frame according to the global gain gradient and a global gain of each frame in previous M frames of the current lost frame. A high frequency band signal of the current lost frame is obtained by adjusting the synthesized high frequency band signal of the current lost frame according to the global gain and a subframe gain of the current lost frame. Hence, the method enables natural and smooth transitions of the high frequency band signal between the frames, and attenuates noises in the high frequency band signal.

22 Claims, 4 Drawing Sheets

Related U.S. Application Data continuation of application No. PCT/CN2014/070199, filed on Jan. 7, 2014.

(51) Int. Cl.
*G10L 19/02* (2013.01)
*G10L 21/0232* (2013.01)
*G10L 25/93* (2013.01)

(58) Field of Classification Search
USPC ..... 704/205, 208, 500
See application file for complete search history.

(56) References Cited

U.S. PATENT DOCUMENTS

| | | | |
|---|---|---|---|
| 5,819,217 | A | 10/1998 | Raman |
| 6,006,178 | A | 12/1999 | Taumi et al. |
| 6,260,010 | B1 | 7/2001 | Gao et al. |
| 6,408,267 | B1 | 6/2002 | Proust |
| 6,418,408 | B1 | 7/2002 | Udaya et al. |
| 6,438,513 | B1 | 8/2002 | Pastor et al. |
| 6,574,593 | B1 | 6/2003 | Gao et al. |
| 6,636,829 | B1 | 10/2003 | Benyassine et al. |
| 6,732,075 | B1 | 5/2004 | Omori et al. |
| 7,457,757 | B1 | 11/2008 | McNeill et al. |
| 7,693,710 | B2 | 4/2010 | Jelinek et al. |
| 8,010,351 | B2 | 8/2011 | Gao |
| 8,069,038 | B2 | 11/2011 | Malah et al. |
| 8,180,064 | B1 | 5/2012 | Avendano et al. |
| 8,185,388 | B2 | 5/2012 | Gao |
| 8,355,911 | B2 | 1/2013 | Zhan et al. |
| 8,457,115 | B2 | 6/2013 | Zhan et al. |
| 9,450,555 | B2 | 9/2016 | Sorensen et al. |
| 2002/0097807 | A1 | 7/2002 | Gerrits |
| 2002/0184010 | A1 | 12/2002 | Eriksson et al. |
| 2003/0200092 | A1 | 10/2003 | Gao et al. |
| 2004/0039464 | A1 | 2/2004 | Virolainen et al. |
| 2004/0064308 | A1 | 4/2004 | Deisher |
| 2004/0068399 | A1 | 4/2004 | Ding |
| 2004/0107090 | A1 | 6/2004 | Oh et al. |
| 2004/0128128 | A1 | 7/2004 | Wang et al. |
| 2004/0166820 | A1 | 8/2004 | Sluijter et al. |
| 2005/0004793 | A1 | 1/2005 | Ojala et al. |
| 2005/0149339 | A1 | 7/2005 | Tanaka et al. |
| 2005/0154584 | A1 | 7/2005 | Jelinek et al. |
| 2006/0020450 | A1 | 1/2006 | Miseki |
| 2006/0262851 | A1 | 11/2006 | Bakfan et al. |
| 2006/0271359 | A1 | 11/2006 | Khalil et al. |
| 2006/0277039 | A1 | 12/2006 | Vos et al. |
| 2007/0033029 | A1 | 2/2007 | Sakawaki |
| 2007/0067163 | A1 | 3/2007 | Kabal et al. |
| 2008/0027715 | A1 | 1/2008 | Rajendran et al. |
| 2008/0033718 | A1 | 2/2008 | Zopf et al. |
| 2008/0040120 | A1 | 2/2008 | Kurniawati et al. |
| 2008/0046233 | A1 | 2/2008 | Chen et al. |
| 2008/0065376 | A1 | 3/2008 | Osada |
| 2008/0071530 | A1 | 3/2008 | Ehara |
| 2008/0077399 | A1 | 3/2008 | Yoshida |
| 2008/0126082 | A1 | 5/2008 | Ehara et al. |
| 2008/0208575 | A1 | 8/2008 | Laaksonen et al. |
| 2008/0312914 | A1 | 12/2008 | Rajendran et al. |
| 2009/0061785 | A1 | 3/2009 | Kawashima et al. |
| 2009/0076808 | A1 | 3/2009 | Xu et al. |
| 2009/0089050 | A1 | 4/2009 | Mo et al. |
| 2009/0141790 | A1 | 6/2009 | Kawashima et al. |
| 2009/0210237 | A1 | 8/2009 | Shen et al. |
| 2009/0316598 | A1 | 12/2009 | Zhan et al. |
| 2010/0057449 | A1 | 3/2010 | Lee et al. |
| 2010/0094642 | A1 | 4/2010 | Zhan et al. |
| 2010/0191522 | A1 | 7/2010 | Zhang et al. |
| 2010/0241425 | A1 | 9/2010 | Eksler et al. |
| 2010/0286805 | A1 | 11/2010 | Gao et al. |
| 2010/0312553 | A1 | 12/2010 | Fang et al. |
| 2011/0007827 | A1 | 1/2011 | Virette et al. |
| 2011/0035213 | A1 | 2/2011 | Malenovsky et al. |
| 2011/0112668 | A1 | 5/2011 | Sorensen et al. |
| 2011/0125505 | A1 | 5/2011 | Vaillancourt et al. |
| 2012/0065984 | A1 | 3/2012 | Yamanashi et al. |
| 2012/0109659 | A1 | 5/2012 | Wu et al. |
| 2012/0121096 | A1 | 5/2012 | Chen et al. |
| 2012/0209599 | A1 | 8/2012 | Malenovsky |
| 2013/0144615 | A1 | 6/2013 | Rauhala et al. |
| 2013/0166287 | A1 | 6/2013 | Gao |
| 2013/0253939 | A1 | 9/2013 | Tsutsumi et al. |
| 2013/0332152 | A1 | 12/2013 | Lecomte et al. |
| 2013/0339038 | A1 | 12/2013 | Norvell et al. |
| 2014/0142957 | A1 | 5/2014 | Sung et al. |
| 2014/0229171 | A1 | 8/2014 | Atti et al. |
| 2014/0236585 | A1 | 8/2014 | Subasingha et al. |
| 2014/0337039 | A1 | 11/2014 | Guan et al. |
| 2015/0036679 | A1 | 2/2015 | Deng et al. |
| 2015/0066491 | A1 | 3/2015 | Bayer et al. |
| 2015/0131429 | A1 | 5/2015 | Liu |
| 2015/0170655 | A1 | 6/2015 | Li et al. |
| 2015/0255074 | A1 | 9/2015 | Jeong et al. |
| 2015/0317994 | A1 | 11/2015 | Ramadas et al. |
| 2016/0019898 | A1 | 1/2016 | Schreiner et al. |
| 2016/0329060 | A1 | 11/2016 | Ito et al. |

FOREIGN PATENT DOCUMENTS

| | | | |
|---|---|---|---|
| CN | 1263625 | A | 8/2000 |
| CN | 1441950 | A | 9/2003 |
| CN | 1984203 | A | 6/2007 |
| CN | 1989548 | A | 6/2007 |
| CN | 101155140 | A | 4/2008 |
| CN | 101321033 | A | 12/2008 |
| CN | 101325537 | A | 12/2008 |
| CN | 101496099 | A | 7/2009 |
| CN | 101578508 | A | 11/2009 |
| CN | 1983909 | B | 7/2010 |
| CN | 102915737 | A | 2/2013 |
| CN | 101286319 | B | 5/2013 |
| CN | 103854649 | A | 6/2014 |
| EP | 1898397 | A1 | 3/2008 |
| JP | H09134198 | A | 5/1997 |
| JP | 2005534950 | A | 11/2005 |
| JP | 2009175693 | A | 8/2009 |
| JP | 2011515712 | A | 5/2011 |
| KR | 20050061615 | A | 6/2005 |
| RU | 2488899 | C1 | 7/2013 |
| WO | 2006098274 | A1 | 9/2006 |
| WO | 2007000988 | A1 | 1/2007 |
| WO | 2012070370 | A1 | 5/2012 |
| WO | 2013060223 | A1 | 5/2013 |
| WO | 2014012391 | A1 | 1/2014 |
| WO | 2014051964 | A1 | 4/2014 |

OTHER PUBLICATIONS

"Series G: Transmission Systems and Media, Digital Systems and Networks, Digital terminal equipments—Coding of voice and audio signals, Frame error robust narrow-band and wideband embedded variable bit-rate coding of speech and audio from 8-32 kbit/s," ITU-T, G.718, Jun. 2008, 257 pages.

"Series G: Transmission Systems and Media, Digital Systems and Networks, Digital terminal equipments—Coding of voice and audio signals, 7 kHz audio-coding within 64 kbit/s," ITU-T, G.722, XP55147503, Part 1, Sep. 2012, 116 pages.

"Series G: Transmission Systems and Media, Digital Systems and Networks, Digital terminal equipments—Coding of voice and audio signals, 7 kHz audio-coding within 64 kbit/s," ITU-T, G.722, XP55147503, Part 2, Sep. 2012, 114 pages.

"Series G: Transmission Systems and Media, Digital Systems and Networks, Digital terminal equipments—Coding of voice and audio signals, 7 kHz audio-coding within 64 kbit/s," ITU-T, G.722, XP55147503, Part 3, Sep. 2012, 44 pages.

Foreign Communication From a Counterpart Application, Japanese Application No. 2016-572825, English Translation of Japanese Office Action dated Feb. 27, 2018, 4 pages.

(56) References Cited

OTHER PUBLICATIONS

Foreign Communication From a Counterpart Application, Russian Application No. 2016151461, English Translation of Russian Search Report dated Apr. 16, 2018, 2 pages.
Foreign Communication From a Counterpart Application, PCT Application No. PCT/CN2014/070199, English Translation of Written Opinion dated Apr. 3, 2014, 2 pages.
Machine Translation and Abstract of Chinese Publication No. CN1984203, Jun. 20, 2007, 11 pages.
Machine Translation and Abstract of Chinese Publication No. CN101155140, Apr. 2, 2008, 12 pages.
Machine Translation and Abstract of Chinese Publication No. CN101286319, Oct. 15, 2008, 8 pages.
Machine Translation and Abstract of Chinese Publication No. CN102915737, Feb. 6, 2013, 27 pages.
Machine Translation and Abstract of Chinese Publication No. CN103854649, Jun. 11, 2014, 54 pages.
Machine Translation and Abstract of Japanese Publication No. JPH09134198, May 20, 1997, 9 pages.
Machine Translation and Abstract of Japanese Publication No. JP2005534950, Nov. 17, 2005, 26 pages.
"Series G: Transmission Systems and Media, Digital Systems and Networks, Digital terminal equipments—Coding of analogue signals by methods other than PCM, G.729-based embedded variable bit-rate coder: An 8-32 kbit/s scalable wideband coder bitstream interoperable with G.729," ITU-T, G.729.1, May 2006, 100 pages.
"Series G: Transmission Systems and Media, Digital Systems and Networks, Digital terminal equipments—Coding of mice and audio signals, Frame error robust narrow-band and wideband embedded variable bit-rate coding of speech and audio from 8-32 kbit/s," ITU-T, G.718, Jun. 2008, 257 pages.
France Telecom, "France Telecom G729EV Candidate: High Level description and complexity evaluation," ITU, COM16-D135-E (WP3/16), XP017538626, Jul. 26—Aug. 5, 2005, 12 pages.
"Series G: Transmission Systems and Media, Digital Systems and Networks, Digital terminal equipments—Coding of mice and audio signals, 7 kHz audio-coding within 64 kbit/s," ITU-T, G.722, XP55147503, Part 1, Sep. 2012, 116 pages.
"Series G: Transmission Systems and Media, Digital Systems and Networks, Digital terminal equipments—Coding of mice and audio signals, 7 kHz audio-coding within 64 kbit/s," ITU-T, G.722, XP55147503, Part 2, Sep. 2012, 114 pages.
"Series G: Transmission Systems and Media, Digital Systems and Networks, Digital terminal equipments—Coding of mice and audio signals, 7 kHz audio-coding within 64 kbit/s," ITU-T, G.722, XP55147503, Part 3, Sep. 2012, 44 pages.
"Enhanced Variable Rate Codec, Speech Service Options 3, 68, 70, 73, and 77 for Wideband Spread Spectrum Digital Systems," 3GPP2 C.S0014-E v1.0, XP062013690, Dec. 2011, 358 pages.
Foreign Communication From A Counterpart Application, Japanese Application No. 2016-572825, Japanese Office Action dated Feb. 27, 2018, 4 pages.
Foreign Communication From A Counterpart Application, Japanese Application No. 2016-572825, English Translation of Japanese Office Action dated Feb. 27, 2018, 5 pages.
Foreign Communication From A Counterpart Application, Singaporean Application No. 11201609526R, Singaporean Search Report dated Mar. 3, 2017, 3 pages.
Foreign Communication From A Counterpart Application, Singaporean Application No. 11201609526R, Singaporean Written Opinion dated Mar. 3, 2017, 6 pages.
Foreign Communication From A Counterpart Application, Japanese Application No. 2016-526411, Japanese Office Action dated Apr. 4, 2017, 4 pages.
Foreign Communication From A Counterpart Application, Japanese Application No. 2016-526411, English Translation of Japanese Office Action dated Apr. 4, 2017, 4 pages.
Foreign Communication From A Counterpart Application, European Application No. 14825749.6, Extended European Search Report dated Apr. 13, 2016, 9 pages.
Foreign Communication From A Counterpart Application, European Application No. 15811619.4, Extended European Search Report dated Apr. 19, 2017, 7 pages.
Foreign Communication From A Counterpart Application, Chinese Application No. 201310297740.1, Chinese Search Report dated May 23, 2017, 3 pages.
Foreign Communication From A Counterpart Application, Chinese Application No. 201310297740.1, Chinese Office Action dated Jun. 2, 2017, 5 pages.
Foreign Communication From A Counterpart Application, Korean Application No. 10-2015-7033976, Korean Office Action dated Aug. 17, 2017, 7 pages.
Foreign Communication From A Counterpart Application, Korean Application No. 10-2015-7033976, Translation of Korean Office Action dated Aug. 17, 2017, 4 pages.
Foreign Communication From A Counterpart Application, Korean Application No. 10-2015-7033976, Korean Office Action and Brief Translation of Notice of Allowance dated Nov. 8, 2017, 4 pages.
Foreign Communication From A Counterpart Application, Russian Application No. 2016151461, Russian Search Report dated Apr. 16, 2018, 2 pages.
7FApplication No. 2016151461, English Translation of Russian Search Report dated Apr. 16, 2018, 2 pages.
Foreign Communication From A Counterpart Application, Russian Application No. 2016151461, Russian Office Action dated Apr. 19, 2018, 4 pages.
Foreign Communication From A Counterpart Application, Russian Application No. 2016151461, Russian Office Action dated Apr. 19, 2018, 2 pages.
Foreign Communication From A Counterpart Application, PCT Application No. PCT/CN2014/070199, English Translation of International Search Report dated Apr. 3, 2014, 2 pages.
Foreign Communication From A Counterpart Application, PCT Application No. PCT/CN2014/070199, English Translation of Written Opinion dated Apr. 3, 2014, 5 pages.
Foreign Communication From A Counterpart Application, PCT Application No. PCT/CN2015/071728, English Translation of International Search Report dated Apr. 28, 2015, 2 pages.
Foreign Communication From A Counterpart Application, PCT Application No. PCT/CN2015/071728, English Translation of Written Opinion dated Apr. 28, 2015, 5 pages.
Machine Translation and Abstract of Chinese Publication No. CN101496099, Jul. 29, 2009, 86 pages.
Foreign Communication From A Counterpart Application, Chinese Application No. 201611045641.4, Chinese Office Action dated Feb. 6, 2020, 4 pages.
Foreign Communication From A Counterpart Application, Chinese Application No. 201611045641.4, Chinese Search Report dated Jan. 21, 2020, 2 pages.

RECOVERING HIGH FREQUENCY BAND SIGNAL OF A LOST FRAME IN MEDIA BITSTREAM ACCORDING TO GAIN GRADIENT

CROSS-REFERENCE TO RELATED APPLICATIONS

This application is a continuation of U.S. patent application Ser. No. 14/981,956 filed on Dec. 29, 2015, which is a continuation of International Patent Application No. PCT/CN2014/070199 filed on Jan. 7, 2014. The International Patent Application No. PCT/CN2014/070199 claims priority to Chinese Patent Application No. 201310297740.1 filed on Jul. 16, 2013. All of the applications are hereby incorporated by reference in their entireties.

TECHNICAL FIELD

The present application relates to the field of communications, and in particular, to method for recovering lost frames.

BACKGROUND

With continuous progress of technologies, users have an increasingly high requirement on speech quality. Expanding speech bandwidth is one of the main methods for improving speech quality. However, if information carried in the added bandwidth is coded in a conventional coding manner, coding bit rates would be greatly increased. Because of this, efficient transmission of a bitstream cannot be achieved due to a limitation of current network bandwidth. Therefore, a bandwidth extension technology is often used. The bandwidth extension technology makes use of the correlation between the low frequency band of a signal and the high frequency band of the signal in order to predict the wider band signal from extracted lower-band features.

After coding a high frequency band signal using the bandwidth extension technology, an encoding side (which comprises an encoder) transmits the coded signal to a decoding side (which comprises a decoder). The decoding side also recovers the high frequency band signal using the bandwidth extension technology. During signal transmission, because of network congestion, network fault or other reasons, frame loss may occur. Since packet loss rate is a key factor affecting the signal quality, in order to recuperate the lost frame as correctly as possible in case of a frame loss, a lost frame recovering technology has been proposed. In this technology, the decoding side uses a synthesized high frequency band signal of a previous frame as a synthesized high frequency band signal of the lost frame, and then adjusts the synthesized high frequency band signal using a subframe gain and a global gain of the current lost frame to obtain a final high frequency band signal. However, in this technology, the subframe gain of the current lost frame is a fixed value, and the global gain of the current lost frame is obtained by multiplying a global gain of the previous frame by a fixed gradient. This may cause discontinuous transitions of the re-established high frequency band signal at before and after the lost frame, and severe noises in the re-established high frequency band signal.

SUMMARY

Embodiments of the present application provide a method for recovering a lost frame, and a decoder configured according to the method. The method can improve quality of decoded high frequency band signals.

According to a first aspect, a method for recovering a lost frame of a media bitstream in a frame loss event is provided, where the method includes obtaining a synthesized high frequency band signal of a current lost frame, obtaining recovery information related to the current lost frame, where the recovery information includes at least one of the following a coding mode of a last frame received before the frame loss event, a frame class of the last frame received before the frame loss event, and a quantity of continuously lost frames, where the quantity of continuously lost frames is a quantity of frames that are continuously lost until the current lost frame in the frame loss event, determining a global gain gradient of the current lost frame according to the recovery information, determining a global gain of the current lost frame according to the global gain gradient and a global gain of each frame in previous M frames of the current lost frame, where M is a positive integer, determining a subframe gain of the current lost frame, and obtaining a high frequency band signal of the current lost frame by adjusting the synthesized high frequency band signal of the current lost frame according to the global gain of the current lost frame and the subframe gain of the current lost frame.

With reference to the first, in a first possible implementation manner, determining the global gain gradient of the current lost frame according to the recovery information comprises determining the global gain gradient of the current lost frame according to the quantity of continuously lost frames and the coding mode or the frame class of the last frame received before the frame loss.

With reference to the first possible implementation manner of the first aspect, in a second possible implementation manner, the global gain gradient of the current lost frame is determined to be 1 if the coding mode of the current lost frame is the same as the coding mode of the last frame received before the frame loss, and the quantity of continuously lost frames is less than or equal to 3, or the frame class of the current lost frame is the same as the frame class of the last frame received before the frame loss, and the quantity of continuously lost frames is less than or equal to 3.

With reference to the first possible implementation manner of the first aspect, in a third possible implementation manner, the global gain gradient of the current lost frame is determined to be less than or equal to a preset first threshold and greater than 0 if it cannot be determined whether the coding mode of the current lost frame is the same as the coding mode of the last frame received before the frame loss or whether the frame class of the current lost frame is the same as the frame class of the last frame received before the frame loss, the last frame received before the frame loss is an unvoiced frame or a voiced frame, and the quantity of continuously lost frames is less than or equal to 3.

With reference to the first aspect, in a fourth possible implementation manner, the global gain gradient of the current lost frame is determined to be greater than a preset first threshold and smaller than 1 if the last frame received before the frame loss is an onset frame of a voiced frame, or the last frame received before the frame loss is an audio frame or a silent frame.

With reference to the first aspect, in a fifth possible implementation manner, the global gain gradient of the current lost frame is determined to be less than or equal to a preset first threshold and greater than 0 if the last frame received before the frame loss is an onset frame of an unvoiced frame.

With reference to the first aspect or any implementation manner of the first possible implementation manner to the fifth possible implementation manner of the first aspect, in a sixth possible implementation manner, the determining the subframe gain of the current lost frame includes determining a subframe gain gradient of the current lost frame according to the quantity of continuously lost frames and the coding mode or the frame class of the last frame received before the frame loss, and determining the subframe gain of the current lost frame according to the subframe gain gradient and a subframe gain of each frame in previous N frames of the current lost frame, where N is a positive integer.

With reference to the sixth possible implementation manner of the first aspect, in a seventh possible implementation manner, the subframe gain gradient of the current lost frame is determined to be less than or equal to a preset second threshold and greater than 0 if it cannot be determined whether the coding mode of the current lost frame is the same as the coding mode of the last frame received before the frame loss or whether the frame class of the current lost frame is the same as the frame class of the last frame received before the frame loss, the last frame received before the frame loss is an unvoiced frame, and the quantity of continuously lost frames is less than or equal to 3.

With reference to the sixth possible implementation manner of the first aspect, in an eighth possible implementation manner, the subframe gain gradient of the current lost frame is determined to be greater than a preset second threshold if the last frame received before the frame loss is an onset frame of a voiced frame.

According to a second aspect, a method for recovering a lost frame of a media bitstream in a frame loss event is provided, where the method includes obtaining a synthesized high frequency band signal of a current lost frame in a frame loss event, obtaining recovery information related to the current lost frame, where the recovery information includes at least one of the following a coding mode of a last frame received before the frame loss event, a frame class of a last frame received before the frame loss, and a quantity of continuously lost frames, where the quantity of continuously lost frames is a quantity of frames that are continuously lost until the current lost frame in the frame loss event, determining a subframe gain gradient of the current lost frame according to the recovery information, determining a subframe gain of the current lost frame according to the subframe gain gradient and a subframe gain of each frame in previous N frames of the current lost frame, where N is a positive integer, determining a global gain of the current lost frame, and obtaining a high frequency band signal of the current lost frame by adjusting the synthesized high frequency band signal of the current lost frame according to the subframe gain of the current lost frame and the global gain of the current lost frame.

With reference to the second aspect, in a first possible implementation manner, wherein determining the subframe gain gradient of the current lost frame according to the recovery information comprises determining the subframe gain gradient of the current lost frame according to the quantity of continuously lost frames and the coding mode or the frame class of the last frame received before the frame loss, the subframe gain gradient of the current lost frame is determined to be less than or equal to a preset second threshold and greater than 0 if it cannot be determined whether a coding mode of the current lost frame is the same as a coding mode of the last frame received before the frame loss or whether a frame class of the current lost frame is the same as the frame class of the last frame received before the frame loss, if the last frame received before the frame loss is an unvoiced frame, and the quantity of continuously lost frames is less than or equal to 3, determining the subframe gain gradient, and enabling the subframe gain gradient to be less than or equal to a preset second threshold and greater than 0.

With reference to the second aspect, in a second possible implementation manner, the subframe gain gradient of the current lost frame is determined to be greater than a preset second threshold if the last frame received before the frame loss is an onset frame of a voiced frame.

According to a third aspect, a decoder is provided, where the decoder comprising a processor and a memory storing program codes, wherein the program codes, when executed by the processor, cause the decoder to perform a process to recover a lost frame of an media bitstream in a frame loss event, wherein the process comprises obtaining a synthesized high frequency band signal of a current lost frame, a obtaining recovery information related to the current lost frame, where the recovery information includes at least one of the following a coding mode of a last frame before the frame loss event, a frame class of a last frame received before the frame loss, and a quantity of continuously lost frames, where the quantity of continuously lost frames is a quantity of frames that are continuously lost until the current lost frame in the frame loss event, determining a global gain gradient of the current lost frame according to the recovery information, determining a global gain of the current lost frame according to the global gain gradient and a global gain of each frame in previous M frames of the current lost frame, where M is a positive integer, determining a subframe gain of the current lost frame, and obtaining a high frequency band signal of the current lost frame by adjusting the synthesized high frequency band signal of the current lost frame according to the global gain of the current lost frame and the subframe gain of the current lost frame.

With reference to the third aspect, in a first possible implementation manner, wherein determining the global gain gradient of the current lost frame according to the recovery information comprises determining the global gain gradient of the current lost frame according to the quantity of continuously lost frames and the coding mode or the frame class of the last frame received before the frame loss.

With reference to the first possible implementation manner of the third aspect, in a second possible implementation manner, wherein the global gain gradient of the current lost frame is determined to be 1 if the coding mode of the current lost frame is the same as the coding mode of the last frame received before the frame loss, and the quantity of continuously lost frames is less than or equal to 3, or the frame class of the current lost frame is the same as the frame class of the last frame received before the frame loss, and the quantity of continuously lost frames is less than or equal to 3.

With reference to the first possible implementation manner of the third aspect, in a third possible implementation manner, the global gain gradient of the current lost frame is determined to be less than or equal to a preset first threshold and greater than 0 if it cannot be determined whether the coding mode of the current lost frame is the same as a coding mode of the last frame received before the frame loss or whether a frame class of the current lost frame is the same as the frame class of the last frame received before the frame loss, the last frame received before the frame loss is an unvoiced frame or a voiced frame, and the quantity of continuously lost frames is less than or equal to 3.

With reference to the third aspect, in a fourth possible implementation manner, the global gain gradient of the current lost frame is determined to be greater than a preset first threshold and smaller than 1 if the last frame received before the frame loss is an onset frame of a voiced frame, or the last frame received before the frame loss is an audio frame or a silent frame.

With reference to the third aspect, in a fifth possible implementation manner, the global gain gradient of the current lost frame is determined to be less than or equal to a preset first threshold and greater than 0 if the last frame received before the frame loss is an onset frame of an unvoiced frame.

With reference to the third aspect or any implementation manner of the first possible implementation manner to the fifth possible implementation manner of the third aspect, in a sixth possible implementation manner, wherein determining the subframe gain of the current lost frame comprises determining a subframe gain gradient of the current lost frame according to the quantity of continuously lost frames and the coding mode or the frame class of the last frame received before the frame loss, and determining the subframe gain of the current lost frame according to the subframe gain gradient and a subframe gain of each frame in previous N frames of the current lost frame, where N is a positive integer.

With reference to the sixth possible implementation manner of the third aspect, in a seventh possible implementation manner, the subframe gain gradient of the current lost frame is determined to be less than or equal to a preset second threshold and greater than 0 if it cannot be determined whether a coding mode of the current lost frame is the same as the coding mode of the last frame received before the frame loss or whether the frame class of the current lost frame is the same as the frame class of the last frame received before the frame loss, the last frame received before the frame loss is an unvoiced frame, and the quantity of continuously lost frames is less than or equal to 3.

With reference to the sixth possible implementation manner of the third aspect, in an eighth possible implementation manner, the subframe gain gradient of the current lost frame is determined to be greater than a preset second threshold if the last frame received before the frame loss is an onset frame of an unvoiced frame.

According to a fourth aspect, a decoder is provided, where the decoder includes a processor and a memory storing program codes, wherein the program codes, when executed by the processor, cause the decoder to perform a process to recover a lost frame in an media bitstream, wherein the process comprises obtaining a synthesized high frequency band signal of a current lost frame in a frame loss event, obtaining recovery information related to the current lost frame, where the recovery information includes at least one of the following a coding mode of a last frame received before the frame loss event, a frame class of the last frame received before the frame loss event, and a quantity of continuously lost frames, where the quantity of continuously lost frames is a quantity of frames that are continuously lost until the current lost frame in the frame loss event, determining a subframe gain gradient of the current lost frame according to the recovery information, determining a subframe gain of the current lost frame according to the subframe gain gradient and a subframe gain of each frame in previous N frames of the current lost frame, where N is a positive integer, and obtaining a high frequency band signal of the current lost frame by adjusting the synthesized high frequency band signal of the current lost frame according to the subframe gain of the current lost frame and a global gain of the current lost frame, to obtain a high frequency band signal of the current lost frame.

With reference to the fourth aspect, in a first possible implementation manner, the subframe gain gradient of the current lost is determined to be less than or equal to a preset second threshold and greater than 0 if it cannot be determined whether a coding mode of the current lost frame is the same as a coding mode of the last frame received before the frame loss or whether a frame class of the current lost frame is the same as the frame class of the last frame received before the frame loss, if the last frame received before the frame loss is an unvoiced frame, and the quantity of continuously lost frames is less than or equal to 3.

With reference to the fourth aspect, in a second possible implementation manner, the subframe gain gradient of the current lost frame is determined to be greater than a preset second threshold if the last frame received before the frame loss is an onset frame of a voiced frame.

In the embodiments of the present application, a global gain gradient of a current lost frame is determined according to recovery information, a global gain of the current lost frame is determined according to the global gain gradient and a global gain of each frame in previous M frames of the current lost frame, and a synthesized high frequency band signal of the current lost frame is adjusted according to the global gain of the current lost frame and a subframe gain of the current lost frame such that transition of a high frequency band signal of the current lost frame can be natural and smooth, and noise in the high frequency band signal can be attenuated, thereby improving quality of the high frequency band signal.

BRIEF DESCRIPTION OF DRAWINGS

The following briefly introduces the accompanying drawings used for describing the embodiments of the present application.

DESCRIPTION OF EMBODIMENTS

Coding and decoding technologies are widely used in various electronic devices such as mobile phones, wireless devices, personal data assistant (PDA) devices, handheld or portable computers, global positioning system (GPS) receivers/navigators, digital cameras, audio/video players, video cameras, video recorders, and monitoring devices.

In order to increase voice signal bandwidth, a bandwidth extension technology is often used. Further, a signal encoding side (which comprises an encoder) encodes (codes) a low frequency band signal using a core-layer encoder, and performs a linear predictive coding (LPC) analysis on a high frequency band signal to obtain a high frequency band LPC coefficient. Then, a high frequency band excitation signal is obtained according to parameters such as pitch period, algebraic codebook, and gains that are obtained by the core-layer encoder. After the high frequency band excitation signal is processed by an LPC synthesis filter that is obtained using an LPC parameter, a synthesized high frequency band signal is obtained. By comparing the original high frequency band signal with the synthesized high frequency band signal, a subframe gain and a global gain are obtained. The foregoing LPC coefficient is converted into a line spectral frequencies (LSF) parameter, and the LSF parameter, the subframe gain, and the global gain are quantized and coded. Finally, a bitstream obtained by means of coding is sent to a decoding side (which comprises a decoder).

After receiving the coded bitstream, the decoding side first parses information about the bitstream to determine whether any frame is lost. If no frame is lost, the bitstream is normally decoded, if the frame loss has occurred, the decoding side should recover the lost frame or frames. A method for recovering a lost frame by the decoding side is described in detail below.

Figure 1:
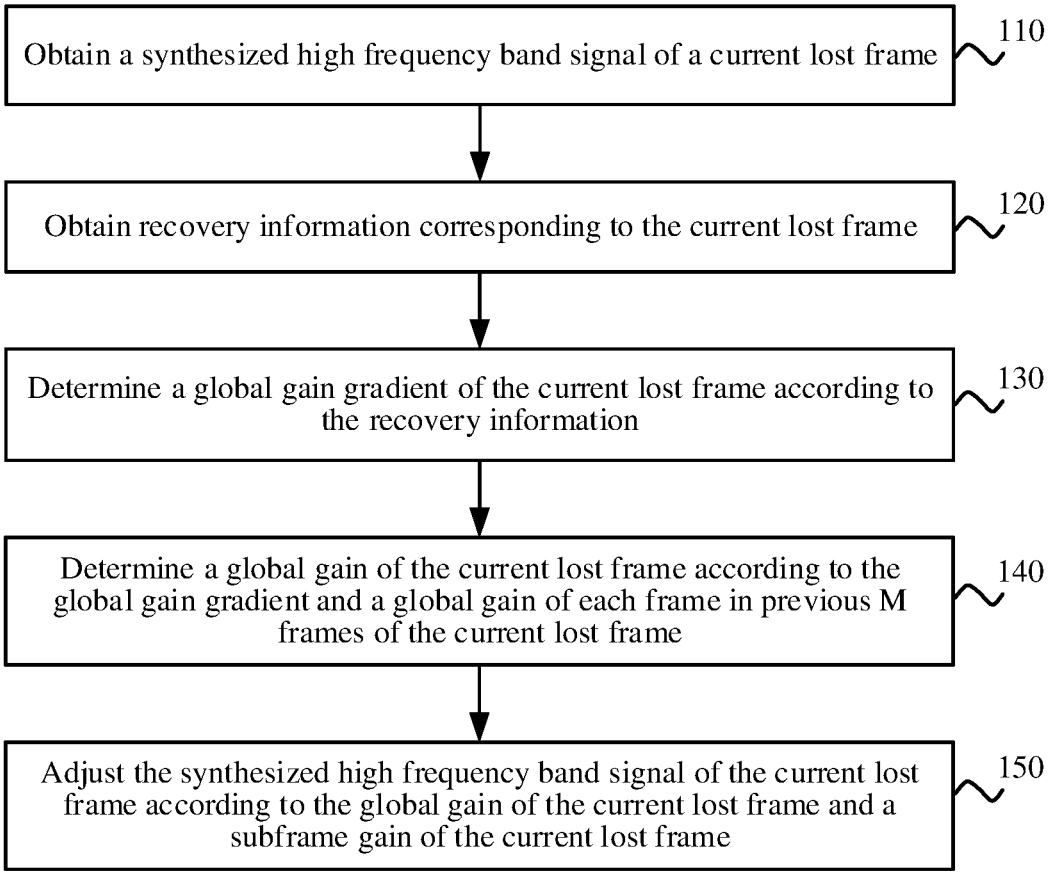
FIG. 1 is a flowchart of a method for recovering a lost frame according to an embodiment of the present application.

FIG. 1 is a flowchart of a method for recovering a lost frame according to an embodiment of the present application. The method in FIG. 1 is executed at the decoding side.

Step 110: Obtain a synthesized high frequency band signal of a current lost frame.

For example, the decoding side obtains a synthesized high frequency band excitation signal of the current lost frame according to a parameter of a previous frame of the current lost frame. Further, the decoding side may use an LPC parameter of the previous frame as an LPC parameter of the current lost frame, and obtain a high frequency band excitation signal using parameters such as a pitch period, an algebraic codebook, and gains of the previous frame that are obtained by a core-layer decoder. The decoding side may use the high frequency band excitation signal as a high frequency band excitation signal of the current lost frame, and then process the high frequency band excitation signal using an LPC synthesis filter that is generated using the LPC parameter, to obtain the synthesized high frequency band signal of the current lost frame.

Step 120: Obtain recovery information corresponding to the current lost frame. The recovery information includes at least one of coding mode before the frame loss, frame class of the last frame received before the frame loss, and a quantity of continuously lost frames, where the quantity of the continuously lost frames is a quantity of frames that are continuously lost until the current lost frame.

The current lost frame is a lost frame that needs to be recovered by the decoding side at a current time.

The coding mode before the frame loss is a coding mode before the occurrence of a current frame loss event. Generally, to achieve better coding performance, an encoding side may classify signals before coding the signals, and select a suitable coding mode for the signal. At present, the coding modes may include a silent frame coding mode (INACTIVE mode), an unvoiced frame coding mode (UNVOICED mode), a voiced frame coding mode (VOICED mode), a generic frame coding mode (GENERIC mode), a transition frame coding mode (TRANSITION mode), and an audio frame coding mode (AUDIO mode).

The frame class of the last frame received before the frame loss is a frame class of a last frame that is received at the decoding side before the occurrence of the current frame loss event. For example, if the encoding side sends four frames to the decoding side, and the decoding side correctly received the first frame and the second frame while the third frame and the fourth frame are lost, the last frame received before the frame loss is the second frame.

Generally, a frame can be classified as following.

(1) An UNVOICED_CLAS frame: a frame that has any one of the following features, unvoiced sound, silence, noise, and end of voiced sound;

(2) An UNVOICED_TRANSITION frame: a frame of transition from unvoiced sound to voiced sound, where the voiced sound is on the onset and is still relatively weak;

(3) A VOICED_TRANSITION frame: a frame of transition after a voiced sound, where the feature of the voice sound is already very weak;

(4) A VOICED_CLAS frame: a frame that has a feature of a voiced sound, where a previous frame of this frame is a voiced frame or an onset of voiced frame;

(5) An ONSET frame: a frame with an onset of an obvious voiced sound;

(6) A SIN_ONSET frame: a frame with an onset of mixed harmonic and noise; or (7) An INACTIVE_CLAS frame: a frame with an inactive feature.

The quantity of continuously lost frames is the quantity of frames that are continuously lost until the current lost frame in the current frame loss event. In essence, the quantity of continuously lost frames indicates a ranking of the current lost frame in the continuously lost frames. For example, the encoding side sends five frames to the decoding side, the decoding side correctly receives the first frame and the second frame, and the third frame to the fifth frame are all lost. If the current lost frame is the fourth frame, the quantity of continuously lost frames is 2, or if the current lost frame is the fifth frame, the quantity of continuously lost frames is 3.

Step 130: Determine a global gain gradient of the current lost frame according to the recovery information.

Step 140: Determine a global gain of the current lost frame according to the global gain gradient and a global gain of each frame in previous M frames of the current lost frame, where M is a positive integer.

For example, the decoding side may weigh the global gains of the previous M frames, and then determine the global gain of the current lost frame according to the weighted global gains of the previous M frames and the global gain gradient of the current lost frame.

Further, a global gain (FramGain) of the current lost frame may be represented by equation (1):

$$\text{FramGain}=f(\alpha,\text{FramGain}(-m)), \tag{1}$$

where FramGain(−m) represents a global gain of the $m^{th}$ frame in the previous M frames, and α represents the global gain gradient of the current lost frame.

For example, the decoding side may determine a global gain (FramGain) of the current lost frame according to the following equation (2):

$$FramGain = \alpha * \sum_{m=1}^{M} w_m FramGain(-m), \text{ where } \sum_{m-1}^{M} w_m = 1, \tag{2}$$

$W_m$ represents a weighting value that corresponds to the $m^{th}$ frame in the previous M frames, FramGain(−m) represents a global gain of the $m^{th}$ frame, and a represents the global gain gradient of the current lost frame.

It should be understood that the example of the foregoing equation (2) is not intended to limit the scope of this embodiment of the present application. A person skilled in the art may make various equivalent modifications or changes based on the equation (1), where these modifications or changes shall also fall within the scope of the present application.

Generally, to simplify the process of step 130, the decoding side may determine the global gain of the current lost frame according to a global gain of the previous frame of the current lost frame and the global gain gradient.

Step 150: Adjust the synthesized high frequency band signal of the current lost frame according to the global gain of the current lost frame and a subframe gain of the current lost frame to obtain a high frequency band signal of the current lost frame.

For example, the decoding side may set the subframe gain of the current lost frame to a fixed value, or the decoding side may determine the subframe gain of the current lost frame in a manner to be described below. Then, the decoding side may adjust the synthesized high frequency band signal of the current lost frame according to the global gain of the current lost frame and the subframe gain of the current lost frame, thereby obtaining the final high frequency band signal of the current lost frame.

In existing technology, the global gain gradient of the current lost frame is a fixed value, and the decoding side obtains the global gain of the current lost frame according to the global gain of the previous frame and the fixed global gain gradient. Adjusting the synthesized high frequency band signal according to the global gain of the current lost frame that is obtained using this method may cause discontinuous transitions of the final high frequency band signal before and after the frame loss, and generation of severe noises. However, in this embodiment of the present application, the decoding side may determine the global gain gradient according to the recovery information, instead of simply setting the global gain gradient to a fixed value. The recovery information describes a related feature of the frame loss event, and therefore, the global gain gradient determined according to the recovery information is more accurate such that the global gain of the current lost frame is also more accurate. The decoding side adjusts the synthesized high frequency signal according to the global gain such that transitions of the re-established high frequency band signal can be natural and smooth, and the noises in the re-established high frequency band signal can be attenuated, thereby improving quality of the re-established high frequency band signal.

Optionally, in step 120, the foregoing global gain gradient $\alpha$ may be represented by an equation (3):

$$\alpha=1.0-\text{Delta}*\text{Scale}, \quad (3)$$

where Delta represents an adjustment gradient of $\alpha$, and a value of Delta may range from 0.5 to 1. Scale represents a tuning amplitude of $\alpha$, which determines a degree at which the current lost frame follows the previous frame in a current condition, and may range from 0 to 1. A smaller value of Scale may indicate that energy of the current lost frame is closer to that of the previous frame, and a larger value may indicate that the energy of the current lost frame is rather weaker than that of the previous frame.

For example, the global gain gradient $\alpha$ is 1 if a coding mode of the current lost frame is the same as a coding mode of the last frame received before the frame loss, and the quantity of continuously lost frames is less than or equal to 3. Or, the global gain gradient $\alpha$ is 1 if a frame class of the current lost frame is the same as the frame class of the last frame received before the frame loss, and the quantity of continuously lost frames is less than or equal to 3.

For another example, in equation (3), if a value of Delta is 0.6, and a value of Scale is 0, then $\alpha$ is 1.

In a case in which it cannot be determined whether a coding mode of the current lost frame is the same as a coding mode of the last frame received before the frame loss or whether a frame class of the current lost frame is the same as the frame class of the last frame received before the frame loss, if the last frame received before the frame loss is an unvoiced frame or a voiced frame, and the quantity of continuously lost frames is less than or equal to 3, the decoder side may determine the global gain gradient to be less than or equal to a preset first threshold and greater than 0.

For example, the decoding side may determine that $\alpha$ is a relatively small value, that is, $\alpha$ may be less than the preset first threshold such as 0.5. If, in equation (3), a value of Delta is 0.65, and a value of Scale is 0.8, then $\alpha$ is 0.48.

In the foregoing embodiment, the decoding side may determine whether the coding mode or frame class of the last frame received before the frame loss is the same as the coding mode or frame class of the current lost frame according to the frame class of the last frame received before the frame loss and/or the quantity of continuously lost frames. For example, if the quantity of continuously lost frames is less than or equal to 3, the decoding side may determine that the coding mode or frame class of the last received frame is the same as the coding mode or frame class of the current lost frame. If the quantity of continuously lost frames is greater than 3, the decoding side cannot determine that the coding mode of the last received frame is the same as the coding mode of the current lost frame. For another example, if the last received frame is an onset frame of a voiced frame or an onset frame of an unvoiced frame, and the quantity of continuously lost frames is less than or equal to 3, the decoding side may determine that the frame class of the current lost frame is the same as the frame class of the last received frame. If the quantity of continuously lost frames is greater than 3, the decoding side cannot determine whether the coding mode of the last frame received before the frame loss is the same as the coding mode of the current lost frame, or whether the frame class of the last received frame is the same as the frame class of the current lost frame.

Optionally, in another instance, if the last frame received before the frame loss is an onset frame of a voiced frame, or if the last frame received before the frame loss is an audio frame or a silent frame, the decoding side may determine the global gain gradient, and make the global gain gradient to be greater than a preset first threshold.

Further, if the decoding side determines that the last frame received before the frame loss is an onset frame of a voiced frame, it may be determined that the current lost frame is probably a voiced frame, and accordingly, it may be determined that $\alpha$ is a relatively large value, that is, $\alpha$ may be greater than the preset first threshold. For example, in equation (3), a value of Delta may be 0.5, and a value of Scale may be 0.4.

If the decoding side determines that the last frame received before the frame loss is an audio frame or a silent frame, it may be also determined that $\alpha$ is a relatively large value, that is, $\alpha$ may be greater than the preset first threshold. For example, in equation (3), a value of Delta may be 0.5, and a value of Scale may be 0.4.

Optionally, as another embodiment, in a case in which the last frame received before the frame loss is an onset frame of an unvoiced frame, the decoding side may determine the global gain gradient, and enable the global gain gradient to be less than or equal to a preset first threshold and greater than 0.

If the last frame received before the frame loss is an onset frame of an unvoiced frame, the current lost frame may be an unvoiced frame, and accordingly, the decoding side may determine that $\alpha$ is a relatively small value, that is, $\alpha$ may be less than the preset first threshold. For example, in equation (3), a value of Delta may be 0.8, and a value of Scale may be 0.65.

In addition, in addition to the cases indicated by the foregoing recovery information, in another case, the decoding side may determine that $\alpha$ is a relatively small value, that is, $\alpha$ may be less than the preset first threshold. For example, in equation (3), a value of Delta may be 0.8, and a value of Scale may be 0.75.

Optionally, a value range of the foregoing first threshold may be 0<the first threshold<1.

Optionally, as another embodiment, the decoding side may determine a subframe gain gradient of the current lost frame according to the recovery information, and determine the subframe gain of the current lost frame according to the subframe gain gradient and a subframe gain of each frame in previous N frames of the current lost frame, where N is a positive integer.

In addition to that the decoding side may determine the global gain gradient of the current lost frame according to the foregoing recovery information, the decoding side may also determine the subframe gain gradient of the current lost frame according to the foregoing recovery information. For example, the decoding side may weight subframe gains of the previous N frames, and then determine the subframe gain of the current lost frame according to the weighted subframe gains and the subframe gain gradient.

Further, a subframe gain (SubGain) of the current lost frame may be represented by an equation (4):

$$\text{SubGain}=f(\beta,\text{SubGain}(-n)), \tag{4}$$

where SubGain(−n) represents a subframe gain of the $n^{th}$ frame in the previous N frames, and $\beta$ represents the subframe gain gradient of the current lost frame.

For example, the decoding side may determine a subframe gain (SubGain) of the current lost frame according to an equation (5):

$$SubGain = \beta * \sum_{n=1}^{N} w_n SubGain(-n), \text{ where } \sum_{n-1}^{N} w_n = 1, \tag{5}$$

$W_n$ represents a weighted value that corresponds to the $n^{th}$ frame in the previous N frames, SubGain(−n) represents a subframe gain of the $n^{th}$ frame, and $\beta$ represents the subframe gain gradient of the current lost frame, where generally, $\beta$ ranges from 1 to 2.

It should be understood that the example of the foregoing equation (5) is not intended to limit the scope of this embodiment of the present application. The person skilled in the art may make various equivalent modifications or changes based on the equation (4), and these modifications or changes also fall within the scope of the present application.

To simplify a process, the decoding side may determine the subframe gain of the current lost frame according to a subframe gain of the previous frame of the current lost frame, and the subframe gain gradient.

It can be seen that, in this embodiment, instead of simply setting a subframe gain of a current lost frame to a fixed value, the subframe gain of the current lost frame is determined after a subframe gain gradient is determined according to recovery information, and therefore, a synthesized high frequency band signal is adjusted according to the subframe gain of the current lost frame and a global gain of the current lost frame such that transition of the high frequency band signal of the current lost frame can be natural and smooth, and noise in the high frequency band signal can be attenuated, thereby improving quality of the high frequency band signal.

Optionally, as another embodiment, in a case in which it cannot be determined whether the coding mode of the current lost frame is the same as the coding mode of the last frame received before the frame loss or whether the frame class of the current lost frame is the same as the frame class of the last frame received before the frame loss, if the last frame received before the frame loss is an unvoiced frame, and the quantity of continuously lost frames is less than or equal to 3, the decoding side may determine the subframe gain gradient, and enable the subframe gain gradient to be less than or equal to a preset second threshold and greater than 0.

For example, the second threshold may be 1.5, and $\beta$ may be 1.25.

Optionally, as another embodiment, in a case in which the last frame received before the frame loss is an onset frame of a voiced frame, the decoding side may determine the subframe gain gradient, and enable the subframe gain gradient to be greater than a preset second threshold.

If the last frame received before the frame loss is an onset frame of a voiced frame, the current lost frame is probably a voiced frame, and the decoding side may determine that $\beta$ is a relatively large value, for example, $\beta$ may be 2.0.

In addition, for $\beta$, in addition to the two cases indicated by the foregoing recovery information, $\beta$ may be 1 in another case.

Optionally, as another embodiment, a value range of the foregoing second threshold is 1<the second threshold<2.

Figure 2:
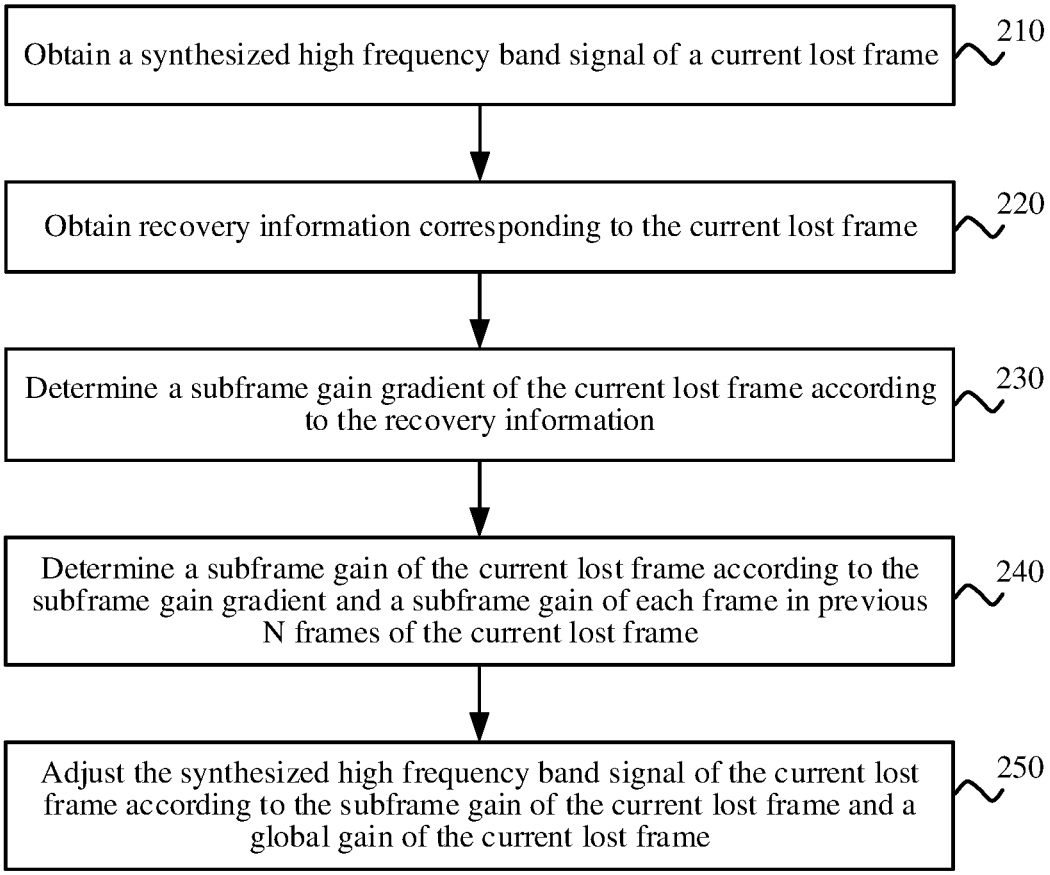
FIG. 2 is a flowchart of a method for recovering a lost frame according to another embodiment of the present application.

FIG. 2 is a flowchart of a method for recovering a lost frame according to another embodiment of the present application. The method in FIG. 2 is executed at a decoding side.

Step 210: Obtain a synthesized high frequency band signal of a current lost frame.

The decoding side may obtain the synthesized high frequency band signal of the current lost frame according to other approaches. For example, the decoding side may obtain a synthesized high frequency band excitation signal of the current lost frame according to a parameter of a previous frame of the current lost frame. Further, the decoding side may use an LPC parameter of the previous frame of the current lost frame as an LPC parameter of the current lost frame, and obtain a high frequency band excitation signal using parameters such as a pitch period, an algebraic codebook, and gains of the previous frame that are obtained by a core-layer decoding. The decoding side may use the high frequency band excitation signal as a high frequency band excitation signal of the current lost frame, and then process the high frequency band excitation signal using an LPC synthesis filter that is generated using the LPC parameter, to obtain the synthesized high frequency band signal of the current lost frame.

Step 220: Obtain recovery information corresponding to the current lost frame. The recovery information includes at least one of coding mode before the frame loss, frame class of the last frame received before the frame loss, and a quantity of continuously lost frames, where the quantity of the continuously lost frames is a quantity of frames that are continuously lost until the current lost frame.

For description of the recovery information, refer to the description in the embodiment of FIG. 1, and details are not described herein again.

Step 230: Determine a subframe gain gradient of the current lost frame according to the recovery information.

Step 240: Determine a subframe gain of the current lost frame according to the subframe gain gradient and a subframe gain of each frame in previous N frames of the current lost frame, where N is a positive integer.

For example, the decoding side may weigh the subframe gains of the previous N frames, and then determine the subframe gain of the current lost frame according to the weighted subframe gains of the previous N frames and the subframe gain gradient of the current lost frame.

Further, a subframe gain (SubGain) of the current lost frame may be represented using the equation (4).

For example, the decoding side may determine a subframe gain (SubGain) of the current lost frame according to the equation (5).

It should be understood that the example of the foregoing equation (5) is not intended to limit the scope of this embodiment of the present application. The person skilled in the art may make various equivalent modifications or changes based on the equation (4), where these modifications or changes also fall within the scope of the present application.

To simplify the process, the decoding side may determine the subframe gain of the current lost frame according to a subframe gain of the previous frame of the current lost frame, and the subframe gain gradient.

Step 250: Adjust the synthesized high frequency band signal of the current lost frame according to the subframe gain of the current lost frame and a global gain of the current lost frame to obtain a high frequency band signal of the current lost frame.

For example, the decoding side may set a fixed global gain gradient according to the other approaches, and then determine the global gain of the current lost frame according to the fixed global gain gradient and a global gain of the previous frame.

In existing technology, the decoding side sets the subframe gain of the current lost frame to a fixed value, and adjusts the synthesized high frequency band signal of the current lost frame according to the fixed value and the global gain of the current lost frame, which causes discontinuous transition of the final high frequency band signal before and after the frame loss, and generation of severe noise. However, in this embodiment of the present application, the decoding side may determine the subframe gain gradient according to the recovery information, and then determine the subframe gain of the current lost frame according to the subframe gain gradient, instead of simply setting the subframe gain of the current lost frame to the fixed value. The recovery information describes a related feature of a frame loss event, and therefore, the subframe gain of the current lost frame is more accurate. Therefore, the decoding side adjusts the synthesized high frequency signal according to the subframe gain such that transition of the re-established high frequency band signal can be natural and smooth, and noise in the re-established high frequency band signal can be attenuated, thereby improving quality of the re-established high frequency band signal.

In this embodiment, a subframe gain gradient of a current lost frame is determined according to recovery information, a subframe gain of the current lost frame is determined according to the subframe gain gradient and a subframe gain of each frame in previous N frames of the current lost frame, and a synthesized high frequency band signal of the current lost frame is adjusted according to the subframe gain of the current lost frame and a global gain of the current lost frame such that transition of a high frequency band signal of the current lost frame can be natural and smooth, and noise in the high frequency band signal can be attenuated, thereby improving quality of the high frequency band signal.

Optionally, as another embodiment, in a case in which it cannot be determined whether a coding mode of the current lost frame is the same as a coding mode of the last frame received before the frame loss or whether a frame class of the current lost frame is the same as the frame class of the last frame received before the frame loss, if the last frame received before the frame loss is an unvoiced frame, and the quantity of continuously lost frames is less than or equal to 3, the decoding side may determine the subframe gain gradient, and enable the subframe gain gradient to be less than or equal to a preset second threshold and greater than 0.

For example, the second threshold may be 1.5, and $\beta$ may be 1.25.

Optionally, as another embodiment, in a case in which the last frame received before the frame loss is an onset frame of a voiced frame, the decoding side may determine the subframe gain gradient, and enable the subframe gain gradient to be greater than a preset second threshold.

If the last frame received before the frame loss is an onset frame of a voiced frame, the current lost frame is probably a voiced frame, and the decoding side may determine that $\beta$ is a relatively large value, for example, $\beta$ may be 2.0.

In addition, for $\beta$, in addition to the two cases indicated by the foregoing recovery information, $\beta$ may be 1 in another case.

Optionally, as another embodiment, a value range of the foregoing second threshold may be 1<the second threshold<2.

It can be seen from the foregoing that, a decoding side may determine a global gain of a current lost frame according to this embodiment of the present application, and determine a subframe gain of the current lost frame according to the other approaches, a decoding side may determine a subframe gain of a current lost frame according to this embodiment of the present application, and determine a global gain of the current lost frame according to the other approaches, or a decoding side may determine a subframe gain of a current lost frame and a global gain of the current lost frame according to this embodiment of the present application. All of the foregoing methods enable transition of a high frequency band signal of the current lost frame to be natural and smooth, and can attenuate noise in the high frequency band signal, thereby improving quality of the high frequency band signal.

Figure 3:
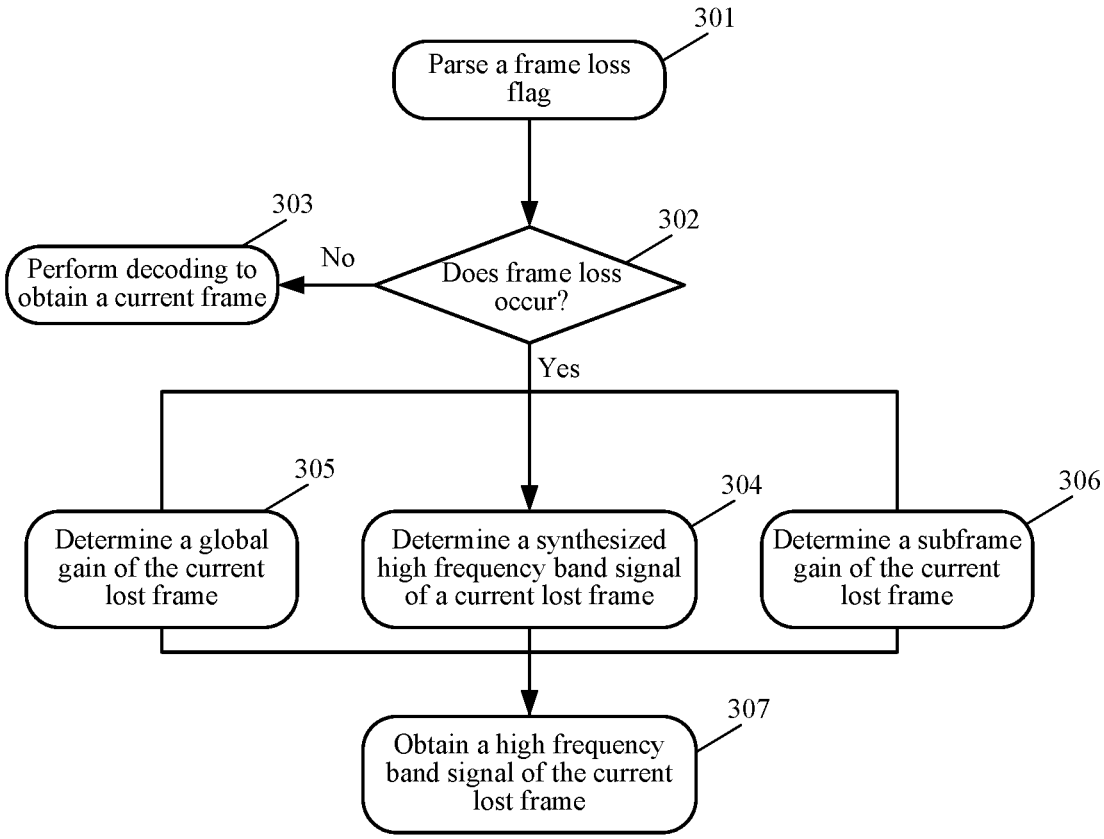
FIG. 3 is a flowchart of a process for recovering a lost frame according to an embodiment of the present application.

FIG. 3 is a flowchart of a process for recovering a lost frame according to an embodiment of the present application.

Step 301: Parse a frame loss flag in a received bitstream.

This process may be executed according to the other approaches.

Step 302: Determine whether a current frame is lost according to the frame loss flag.

If the frame loss flag indicates that the current frame is not lost, step 303 is executed.

If the frame loss flag indicates that the current frame is lost, steps 304 to 306 are executed.

Step 303: If the frame loss flag indicates that the current frame is not lost, decode the bitstream to obtain the current frame.

If the frame loss flag indicates that the current frame is lost, steps 304 to 306 may be executed simultaneously, or steps 304 to 306 are executed in a specific sequence, which is not limited in this embodiment of the present application.

Step 304: Determine a synthesized high frequency band signal of a current lost frame.

For example, the decoding side may determine a synthesized high frequency band excitation signal of the current lost frame according to a parameter of a previous frame of the current lost frame. Further, the decoding side may use an LPC parameter of the previous frame of the current lost frame as an LPC parameter of the current frame, and may obtain a high frequency band excitation signal using parameters such as a pitch period, an algebraic codebook, and gains that are obtained by a core-layer decoding of the previous frame. The decoding side may use the high frequency band excitation signal as a high frequency band excitation signal of the current lost frame, and then process the high frequency band excitation signal using an LPC synthesis filter that is generated using the LPC parameter, to obtain the synthesized high frequency band signal of the current lost frame.

Step 305: Determine a global gain of the current lost frame.

Optionally, the decoding side may determine a global gain gradient of the current lost frame according to recovery information of the current lost frame, where the recovery information may include at least one of a coding mode before frame loss, a frame class of a last frame received before the frame loss, and a quantity of continuously lost frames, and then determine the global gain of the current lost frame according to the global gain gradient of the current lost frame and a global gain of each frame in previous M frames.

For example, optionally, the decoding side may further determine the global gain of the current lost frame according to the other approaches. For example, the global gain of the current lost frame may be obtained by multiplying a global gain of the previous frame by a fixed global gain gradient.

Step 306: Determine a subframe gain of the current lost frame.

Optionally, the decoding side may also determine a subframe gain gradient of the current lost frame according to the recovery information of the current lost frame, and then determine the subframe gain of the current lost frame according to the global gain gradient of the current lost frame and a subframe gain of each frame in previous N frames.

Optionally, the decoding side may determine the subframe gain of the current lost frame according to the other approaches. For example, set the subframe gain of the current lost frame to a fixed value.

It should be understood that, to improve quality of a re-established high frequency band signal that corresponds to the current lost frame, if the global gain of the current lost frame is determined in step 305 according to the other approaches, in step 306, the subframe gain of the current lost frame needs to be determined according to the method in the embodiment of FIG. 2. If the global gain of the current lost frame is determined in step 305 using the method in the embodiment of FIG. 1, in step 306, the subframe gain of the current lost frame may be determined using the method in the embodiment of FIG. 2, or the subframe gain of the current lost frame may be determined according to the other approaches.

Step 307: Adjust, according to the global gain of the current lost frame that is obtained in step 305 and the subframe gain of the current lost frame that is obtained in step 306, the synthesized high frequency band signal obtained in step 304 to obtain a high frequency band signal of the current lost frame.

Figure 4:
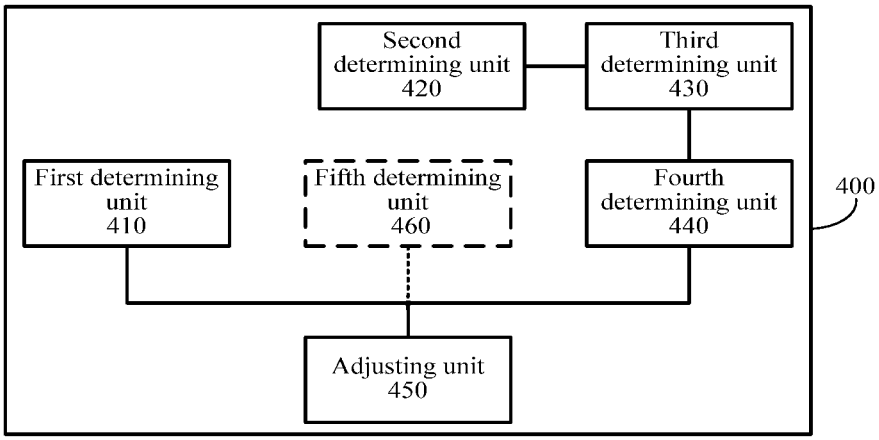
FIG. 4 is a functional block diagram of a decoder according to an embodiment of the present application.

FIG. 4 is a functional block diagram of a decoder 400 according to an embodiment of the present application. The decoder 400 includes hardware components and circuitries that are programmed to perform various functions. The functions, if divided by functional units, include a first determining unit 410, a second determining unit 420, a third determining unit 430, a fourth determining unit 440, and an adjusting unit 450.

The first determining unit 410 determines a synthesized high frequency band signal of a current lost frame. The second determining unit 420 determines recovery information that corresponds to the current lost frame, where the recovery information includes at least one of a coding mode before frame loss, a frame class of a last frame received before the frame loss, and a quantity of continuously lost frames, where the quantity of continuously lost frames is a quantity of frames that are continuously lost until the current lost frame. The third determining unit 430 determines a global gain gradient of the current lost frame according to the recovery information. The fourth determining unit 440 determines a global gain of the current lost frame according to the global gain gradient and a global gain of each frame in previous M frames of the current lost frame, where M is a positive integer. A subframe gain of the current lost frame is determined. The adjusting unit 450 adjusts the synthesized high frequency band signal of the current lost frame according to the global gain of the current lost frame and the subframe gain of the current lost frame to obtain a high frequency band signal of the current lost frame.

A fifth determining unit 460 may further be included. The fifth determining unit 460 may determine a subframe gain gradient of the current lost frame according to the recovery information. The fifth determining unit 460 may determine the subframe gain of the current lost frame according to the subframe gain gradient and a subframe gain of each frame in previous N frames of the current lost frame, where N is a positive integer.

For other functions and operations of the decoder 400, refer to the processes as depicted in FIG. 1, FIG. 2 and FIG. 3, and details are not described herein again to avoid repetition.

Figure 5:
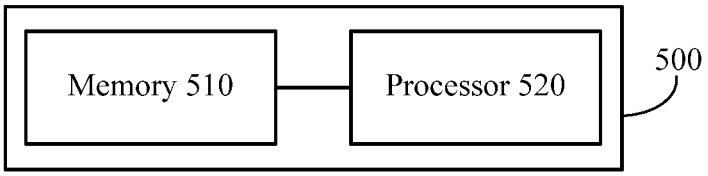
FIG. 5 is a simplified block diagram of a decoder according to embodiments of the present application.

FIG. 5 is a simplified block diagram of a decoder 500 according to an embodiment of the present application. The decoder 500 includes a memory 510 and a processor 520.

The memory 510 may be a random access memory (RAM), a flash memory, a read-only memory (ROM), a programmable ROM (PROM), a non-volatile memory, a register, or the like. The processor 520 may be a central processing unit (CPU).

The memory 510 is configured to store computer executable instructions. The processor 520 by executing the executable instructions stored in the memory 510, performs a series of tasks to obtain a synthesized high frequency band signal of a current lost frame, obtain recovery information that corresponds to the current lost frame, where the recovery information includes at least one of a coding mode before frame loss, a frame class of a last frame received before the frame loss, and a quantity of continuously lost frames, where the quantity of continuously lost frames is a quantity of frames that are continuously lost until the current lost frame, determine a global gain gradient of the current lost frame according to the recovery information, determine a global gain of the current lost frame according to the global gain gradient and a global gain of each frame in previous M frames of the current lost frame, where M is a positive integer, and adjust the synthesized high frequency band signal of the current lost frame according to the global gain of the current lost frame and a subframe gain of the current lost frame, to obtain a high frequency band signal of the current lost frame.

In one implementation manner, a global gain gradient of a current lost frame is determined according to recovery information, a global gain of the current lost frame is determined according to the global gain gradient and a global gain of each frame in previous M frames of the current lost frame, and a synthesized high frequency band signal of the current lost frame is adjusted according to the global gain of the current lost frame and a subframe gain of the current lost frame.

In an alternative implementation manner, a subframe gain gradient of the current lost frame is determined according to the recovery information, a subframe gain of the current lost frame is determined according to the subframe gain gradient and a subframe gain of each frame in previous N frames of the current lost frame. The synthesized high frequency band signal of the current lost frame is adjusted according to the subframe gain of the current lost frame and the global gain of the current lost frame.

Using the above-described process, transition of a high frequency band signal of the current lost frame can be natural and smooth, and noise in the high frequency band signal can be attenuated, thereby improving quality of the high frequency band signal.

For other functions and operations of the decoder 500, refer to the processes in the method embodiments in FIG. 1, FIG. 2 and FIG. 3, and details are not described herein again to avoid repetition.

What is claimed is:

1. A method for recovering a lost frame of a media bitstream, comprising:

obtaining a synthesized high frequency band signal of a current lost frame;

obtaining recovery information related to the current lost frame, wherein the recovery information comprises a coding mode of a previous frame and a frame class of a last frame received before the current lost frame;

determining a global gain gradient of the current lost frame according to the recovery information;

determining a global gain of the current lost frame according to the global gain gradient and a global gain of each frame in previous M frames of the current lost frame, wherein M is a positive integer;

determining a subframe gain of the current lost frame; and adjusting the synthesized high frequency band signal of the current lost frame according to the global gain of the current lost frame and the subframe gain of the current lost frame to obtain a high frequency band signal of the current lost frame.

2. The method of claim 1, wherein the global gain gradient of the current lost frame is determined according to a quantity of continuously lost frames, the coding mode of the previous frame, and the frame class of the last frame received before the current lost frame.

3. The method of claim 2, wherein the global gain gradient of the current lost frame is determined to be one when:

a coding mode of the current lost frame is the same as the coding mode of the previous frame, and the quantity of continuously lost frames is less than or equal to three; or a frame class of the current lost frame is the same as the frame class of the last frame received before the current lost frame, and the quantity of continuously lost frames is less than or equal to three.

4. The method of claim 2, wherein the global gain gradient of the current lost frame is determined to be less than or equal to a preset first threshold and greater than zero when it cannot be determined whether a coding mode of the current lost frame is the same as the coding mode of the previous frame or whether a frame class of the current lost frame is the same as the frame class of the last frame received before the frame loss, wherein the last frame received before the current lost frame comprises an unvoiced frame or a voiced frame, and wherein the quantity of continuously lost frames is less than or equal to three.

5. The method of claim 1, wherein the global gain gradient of the current lost frame is determined to be greater than a preset first threshold and smaller than one when the last frame received before the current lost frame comprises an onset frame of a voiced frame, an audio frame, or a silent frame.

6. The method of claim 1, wherein the global gain gradient of the current lost frame is determined to be less than or equal to a preset first threshold and greater than zero when the last frame received before the current lost frame comprises an onset frame of an unvoiced frame.

7. The method of claim 1, wherein the subframe gain gradient of the current lost frame is determined according to a quantity of continuously lost frames, the coding mode of the previous frame, and the frame class of the last frame received before the current lost frame, wherein the subframe gain of the current lost frame is determined according to the subframe gain gradient and a subframe gain of each frame in previous N frames of the current lost frame, wherein N is a positive integer.

8. The method of claim 7, wherein the subframe gain gradient of the current lost frame is determined to be less than or equal to a preset second threshold and greater than zero when it cannot be determined whether a coding mode of the current lost frame is the same as the coding mode of the previous frame or whether a frame class of the current lost frame is the same as the frame class of the last frame received before the current lost frame, the last frame received before the current lost frame comprises an unvoiced frame, and the quantity of continuously lost frames is less than or equal to three.

9. The method of claim 7, wherein the subframe gain gradient of the current lost frame is determined to be greater than a preset second threshold when the last frame received before the current lost frame comprises an onset frame of a voiced frame.

10. A method for recovering a lost frame of a media bitstream, comprising:

obtaining a synthesized high frequency band signal of a current lost frame;

obtaining recovery information related to the current lost frame, wherein the recovery information comprises a coding mode of a previous frame and a frame class of a last frame received before the current lost frame;

determining a subframe gain gradient of the current lost frame according to the recovery information;

determining a subframe gain of the current lost frame according to the subframe gain gradient and a subframe gain of each frame in previous N frames of the current lost frame, wherein N is a positive integer;

determining a global gain of the current lost frame; and adjusting the synthesized high frequency band signal of the current lost frame according to the subframe gain of the current lost frame and the global gain of the current lost frame to obtain a high frequency band signal of the current lost frame.

11. The method of claim 10, wherein the subframe gain gradient of the current lost frame is determined according to a quantity of continuously lost frames, the coding mode of the previous frame, and the frame class of the last frame received before the current lost frame, and wherein the subframe gain gradient of the current lost frame is determined to be less than or equal to a preset threshold and greater than zero when it cannot be determined whether a coding mode of the current lost frame is the same as the coding mode of the previous frame or whether a frame class of the current lost frame is the same as the frame class of the last frame received before the current lost frame, and the last frame received before the current lost frame comprises an unvoiced frame, and the quantity of continuously lost frames is less than or equal to three.

12. The method of claim 10, wherein the subframe gain gradient of the current lost frame is determined to be greater than a preset threshold when the last frame received before the current lost frame comprises an onset frame of a voiced frame.

13. A decoder, comprising:

a memory storing program codes; and a processor coupled to the memory, the program codes causing the processor to be configured to:

obtain a synthesized high frequency band signal of a current lost frame;

obtain recovery information related to the current lost frame, wherein the recovery information comprises a coding mode of a previous frame and a frame class of a last frame received before the current lost frame;

determine a global gain gradient of the current lost frame according to the recovery information;

determine a global gain of the current lost frame according to the global gain gradient and a global gain of each frame in previous M frames of the current lost frame, wherein M is a positive integer;

determine a subframe gain of the current lost frame; and adjust the synthesized high frequency band signal of the current lost frame according to the global gain of the current lost frame and the subframe gain of the current lost frame to obtain a high frequency band signal of the current lost frame.

14. The decoder of claim 13, wherein the global gain gradient of the current lost is determined according to a quantity of continuously lost frames, the coding mode of the previous frame, and the frame class of the last frame received before the current lost frame.

15. The decoder of claim 14, wherein the global gain gradient of the current lost frame is determined to be one when:

a coding mode of the current lost frame is the same as the coding mode of the previous frame, and the quantity of continuously lost frames is less than or equal to three; or a frame class of the current lost frame is the same as the frame class of the last frame received before the current lost frame, and the quantity of continuously lost frames is less than or equal to three.

16. The decoder of claim 14, wherein the global gain gradient of the current lost frame is determined to be less than or equal to a preset first threshold and greater than zero when it cannot be determined whether a coding mode of the current lost frame is the same as the coding mode of the previous frame or whether a frame class of the current lost frame is the same as the frame class of the last frame received before the current lost frame, wherein the last frame received before the current lost frame comprises an unvoiced frame or a voiced frame, and wherein the quantity of continuously lost frames is less than or equal to three.

17. The decoder of claim 13, wherein the global gain gradient of the current lost frame is determined to be greater than a preset first threshold and smaller than one when the last frame received before the current lost frame comprises an onset frame of a voiced frame, an audio frame, or a silent frame.

18. The decoder of claim 13, wherein the global gain gradient of the current lost frame is determined to be less than or equal to a preset first threshold and greater than zero when the last frame received before the current lost frame comprising an onset frame of an unvoiced frame.

19. The decoder of claim 13, wherein the subframe gain gradient of the current lost frame is determined according to a quantity of continuously lost frames and the coding mode of the previous frame and the frame class of the last frame received before the current lost frame, wherein the subframe gain of the current lost frame is determined according to the subframe gain gradient and a subframe gain of each frame in previous N frames of the current lost frame, and wherein N is a positive integer.

20. The decoder of claim 19, wherein the subframe gain gradient of the current lost frame is determined to be less than or equal to a preset second threshold and greater than zero when it cannot be determined whether a coding mode of the current lost frame is the same as the coding mode of the previous frame or whether a frame class of the current lost frame is the same as the frame class of the last frame received before the current lost frame, the last frame received before the current lost frame comprises an unvoiced frame, and the quantity of continuously lost frames is less than or equal to three.

21. The decoder of claim 19, wherein the subframe gain gradient of the current lost frame is determined to be greater than a preset second threshold when the last frame received before the current lost frame comprises an onset frame of an unvoiced frame.

22. A decoder, comprising:

a memory storing program codes; and a processor coupled to the memory, the program codes causing the processor to be configured to:

obtain a synthesized high frequency band signal of a current lost frame;

obtain recovery information related to the current lost frame, wherein the recovery information comprises a coding mode of a previous frame and a frame class of a last frame received before the current lost frame;

determine a subframe gain gradient of the current lost frame according to the recovery information;

determine a subframe gain of the current lost frame according to the subframe gain gradient and a subframe gain of each frame in previous N frames of the current lost frame, wherein N is a positive integer;

determine a global gain of the current lost frame; and adjust the synthesized high frequency band signal of the current lost frame according to the subframe gain of the current lost frame and the global gain of the current lost frame to obtain a high frequency band signal of the current lost frame.

* * * * *